US011661826B2

(12) United States Patent
Dusterhoft et al.

(10) Patent No.: US 11,661,826 B2
(45) Date of Patent: May 30, 2023

(54) WELL FLOW CONTROL USING DELAYED SECONDARY SAFETY VALVE

(71) Applicant: Halliburton Energy Services, Inc., Houston, TX (US)

(72) Inventors: Ross Glen Dusterhoft, Carrollton, TX (US); Brad Richard Pickle, Carrollton, TX (US); Charles David McFate, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 162 days.

(21) Appl. No.: 17/243,311

(22) Filed: Apr. 28, 2021

(65) Prior Publication Data

US 2022/0349279 A1 Nov. 3, 2022

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01); *E21B 2200/05* (2020.05)

(58) Field of Classification Search
CPC ..... E21B 43/12; E21B 34/08; E21B 2200/05; E21B 34/105; E21B 34/106; E21B 34/107
See application file for complete search history.

(56) References Cited

U.S. PATENT DOCUMENTS 4,605,070 A * 8/1986 Morris ..... E21B 34/106 166/380
6,352,118 B1 3/2002 Dickson et al.
7,918,280 B2 * 4/2011 Mailand ..... E21B 34/10 166/240
8,511,374 B2 * 8/2013 Scott ..... E21B 34/106 166/381
9,133,688 B2 * 9/2015 Jancha ..... E21B 34/12
9,739,116 B2 * 8/2017 Kirkpatrick ..... E21B 34/106
9,909,387 B2 * 3/2018 Scott ..... E21B 23/02
10,513,908 B2 * 12/2019 Scott ..... E21B 34/106
11,041,364 B2 * 6/2021 Ostrovskiy ..... E21B 34/106
11,136,861 B2 * 10/2021 Williamson ..... E21B 34/16
11,248,441 B2 * 2/2022 Vick, Jr. ..... E21B 34/14
(Continued)

FOREIGN PATENT DOCUMENTS

CA 2636887 3/2012
GB 2173235 10/1986
WO 2017-155550 9/2017

OTHER PUBLICATIONS

International Search Report and Written Opinion for Application No. PCT/US2021/031154, dated Jan. 21, 2022.

*Primary Examiner* — Taras P Bemko
(74) *Attorney, Agent, or Firm* — Scott Richardson; C. Tumey Law Group PLLC

(57) ABSTRACT

A flow control system for a well includes a primary safety valve and a secondary safety valve disposable within a valve body of the primary safety valve. The secondary safety valve may include a control line port for receiving control fluid pressure from the same control line as the primary safety valve. A choke in fluid communication with the control line port delays a closing of the secondary safety valve relative to a closing of the primary safety valve in response to a decrease in the control fluid pressure.

19 Claims, 5 Drawing Sheets

(56) References Cited

U.S. PATENT DOCUMENTS

2010/0025045 A1* 2/2010 Lake ..... E21B 34/066 166/373
2011/0265990 A1 11/2011 Augustine et al.
2012/0168175 A1* 7/2012 Lauderdale ..... E21B 34/10 166/334.1
2013/0032355 A1* 2/2013 Scott ..... E21B 34/066 166/373
2013/0220624 A1* 8/2013 Hill, Jr. ..... E21B 34/14 166/321
2013/0341034 A1 12/2013 Biddick et al.
2014/0034325 A1* 2/2014 Jancha ..... E21B 34/12 166/321
2014/0251627 A1 9/2014 Holderman et al.
2014/0262232 A1 9/2014 Dusterhoft et al.
2014/0262301 A1 9/2014 Holderman et al.
2014/0278316 A1 9/2014 Dusterhoft et al.
2015/0000982 A1 1/2015 McDowell et al.
2015/0075777 A1 3/2015 Walters et al.
2015/0075778 A1 3/2015 Walters et al.
2015/0075779 A1 3/2015 Walters et al.
2015/0248502 A1 9/2015 Rath et al.
2017/0191358 A1 7/2017 Maxey et al.
2018/0238159 A1 8/2018 Nguyen et al.
2018/0328145 A1* 11/2018 Gonzalez ..... E21B 34/14
2018/0328827 A1 11/2018 Martysevich et al.
2018/0329113 A1 11/2018 Walters et al.
2019/0080224 A1 3/2019 Madasu et al.
2019/0264552 A1 8/2019 Martysevich et al.
2019/0376366 A1 12/2019 Burris et al.
2020/0190396 A1 6/2020 Reyes et al.
2020/0216745 A1 7/2020 Rama et al.
2021/0010359 A1 1/2021 Ruhle et al.
2021/0010361 A1 1/2021 Kriebel et al.
2021/0010362 A1 1/2021 Kriebel et al.
2021/0010363 A1 1/2021 Kriebel et al.
2021/0081710 A1 3/2021 Jaaskelainen et al.

* cited by examiner

WELL FLOW CONTROL USING DELAYED SECONDARY SAFETY VALVE

BACKGROUND

A subsurface safety valve (alternately referred to as an "SSV") is commonly installed as part of the production tubing within oil and gas wells to protect against unwanted communication of high pressure and high temperature formation fluids to the surface. These subsurface safety valves are designed to shut in fluid production from the formation in response to a variety of abnormal and potentially dangerous conditions.

As built into the production tubing, subsurface safety valves are typically referred to as tubing retrievable safety valves ("TRSV") since they can be retrieved by retracting the production tubing back to surface. TRSVs are normally operated by hydraulic fluid pressure, which is typically controlled at the surface and transmitted to the TRSV via hydraulic control lines. Hydraulic fluid pressure must be applied to the TRSV to place the TRSV in the open position. When hydraulic fluid pressure is lost, the TRSV will transition to the closed position to prevent formation fluids from traveling uphole through the TRSV and reaching the surface. As such, TRSVs are commonly characterized as fail-safe valves, as their default position is closed.

As TRSVs are often subjected to years of service in severe operating conditions, failure of the TRSV is possible. For example, a TRSV in the closed position may eventually form leak paths. Alternatively, a TRSV in the closed position may not properly open when actuated. Because of the potential for operational problems in the absence of a properly functioning TRSV, mitigation measure must be taken promptly. Since they are incorporated into the production tubing, however, repairing or replacing a malfunctioning TRSV requires removal of the entire production tubing, which can be an expensive undertaking.

To avoid the costs and time of repairing or replacing a malfunctioning TRSV, a wireline retrievable safety valve ("WLRSV") may instead be installed in the TRSV and operated to provide the same safety function as the TRSV. WLRSVs are typically designed to be lowered into the wellbore from the surface via wireline and are then locked inside the original TRSV. This approach can be a much more efficient and cost-effective alternative to pulling the production tubing to replace or repair the malfunctioning TRSV. One common obstacle in using WLRSVs, however, is how to provide hydraulic pressure to the WLRSV for proper operation once installed.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
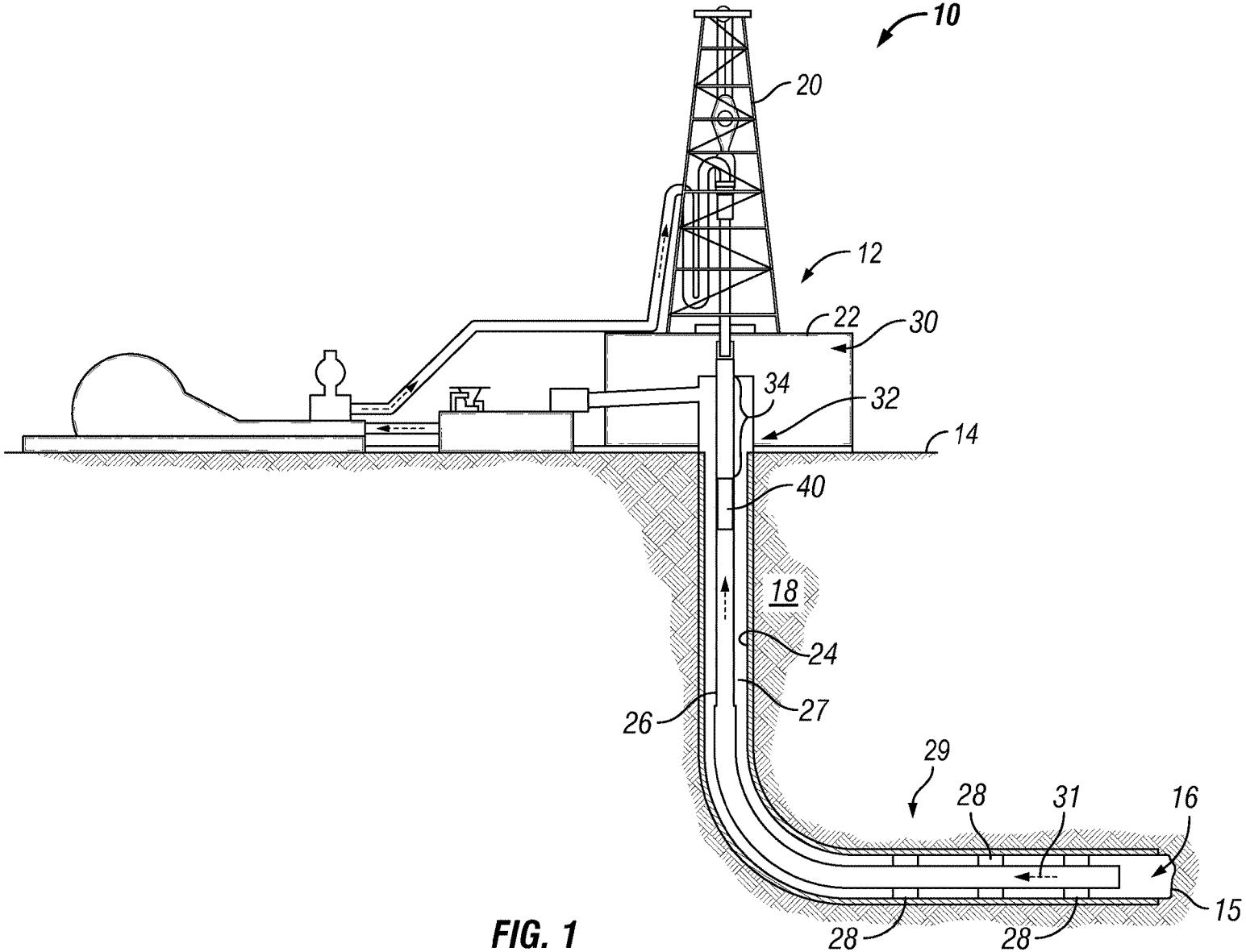
FIG. 1 is an example of a well site in which a subsurface flow control system according to this disclosure may be implemented.

A subsurface flow control system includes primary and secondary subsurface safety valves (SSVs), wherein closing of the secondary SSV is time-delayed with respect to closing of the primary SSV. The secondary SSV may close more gently as a result of the delay because the primary SSV has already at least reduced flow and pressure of production fluid upward through the flow control system. Even a leaking primary SSV may significantly reduce flow to the secondary SSV when the primary SSV is closed. As a result, a less robust secondary SSV (e.g., lower slam closure rating) may now be used as a backup to a primary SSV with a much higher slam closure rating. For example, it may be possible to now qualify a smaller flapper-style WLRSV in a "slam" test that presumes a certain flow rate and/or velocity of production fluid through the WLRSV because, by first closing the primary SSV, the flow rate and/or velocity seen by the secondary SSV will be significantly lower.

Generally, the secondary SSV may be independently deployed and/or retrieved on a conveyance that is separate from the conveyance that the primary SSV was deployed on. The flow control system may initially be operated with only the primary SSV in place during production of well fluids such as oil and gas from a hydrocarbon formation. The secondary SSV may be subsequently installed inside of the primary SSV as a backup to the primary SSV, such as if the primary SSV develops a leaking valve closure element (e.g., flapper). When the backup SSV is installed, the primary and backup SSVs may receive control fluid pressure from the same hydraulic control line to hold their respective flappers open against the biasing action of respective springs that would otherwise urge the hydraulic actuators to close the respective flappers. When control fluid pressure at the control line is reduced below a threshold, the flappers of both SSVs close. However, the closing of the backup SSV is delayed with respect to closing of the primary SSV via a choke.

A specific example embodiment discussed includes a TRSV as the primary SSV and a WLRSV as the backup SSV. The TRSV may be installed with production tubing as part of the original completions. The WLRSV may be independently deployed on a wireline or its equivalent. The WLRSV may nest inside the TRSV, with the lower end of the WLRSV uphole of the flapper of the TRSV to avoid interference therebetween. A choke is provided along a control fluid flow path to the WLRSV. When control fluid pressure at the control line is shut off or reduced below the threshold necessary to close both the TRSV and WLRSV, the choke causes the control fluid pressure to the WLRSV to be reduced more slowly than control fluid pressure to the TRSV. This results in a time delay of the closing of the WLRSV with respect to the TRSV. The choke parameters (e.g., amount of flow restriction) may be selected to control the delay. Preferably, the delay is sufficient that the TRSV flapper is fully closed before the WLRSV flapper begins to close.

FIG. 1 is an example of a well site 10 in which a subsurface flow control system 40 according to this disclosure may be implemented. While FIG. 1 generally depicts the well site 10 as being for land-based hydrocarbon production, the principles described herein are equally applicable to offshore or subsea production operations that employ floating or sea-based platforms and rigs, without departing from the scope of the disclosure. The well site 10 may include an oil and gas rig 12 arranged at the earth's surface 14 and a wellbore 16 extending therefrom and penetrating a subterranean earth formation 18. The wellbore 16 may be completed and ready for production or already producing in this example. A large support structure such as a derrick 20 is erected at the well site 10 on a support foundation or platform, such as a rig floor 22. In a subsea context, the earth's surface 14 may alternatively represent the floor of a seabed, and the rig floor 22 may be on the offshore platform or floating rig over the water above the seabed. The derrick 20 may be used to support equipment in constructing, completing, producing from, or servicing the wellbore 16. The derrick 20 may be used, for example, to support and manipulate the axial position of a tubing string, a wireline, or other conveyance within the wellbore 16. Such a conveyance may serve various functions, such as to lower and retrieve tools such as subsurface safety valves, to convey fluids from or to the surface 14, and/or to support the communication of signals and power during wellbore operations.

The wellbore 16 may follow any given wellbore path extending from the surface 14 to a toe 15 of the wellbore 16. The wellbore 16 in this example includes a vertical section extending from the surface 14, followed by a horizontal section passing through a production zone 29, and terminating at a toe 15 of the wellbore 16. Portions of the wellbore 16 may be reinforced with tubular metal casing 24 cemented within the wellbore 16. Production tubing 26 is installed inside the wellbore 16, which serves as a fluid conduit for production fluid 31 such as crude oil or gas extracted from the subterranean formation 18 to the surface 14 via the wellhead 32. The production tubing 26 may be interior to the casing 24 such that an annulus 27 is formed between the production tubing and the casing 24. Packers 28 are positioned in the annulus 27 to seal the production tubing 26 to the casing 24 such that production fluid 31 is directed uphole through the production tubing 26.

A production tree 30 may be positioned proximate a wellhead 32 to control the flow of the production fluid 31 out of the wellbore 16. The subsurface flow control system 40 is downhole from the production tree 30 to shut off flow of the production fluid 31 in response to a shut-in event. A shut-in event may be any emergency or other event that results in an effort to shut-in the well using the subsurface flow control system 40 to stop the flow of production fluid 31. A shut-in event may be associated with, for example, a well failure. Shutting-in the well in response to a shut-in event may help prevent uncontrolled flowing production fluid, which could otherwise cause explosions, damage to surface facilities, and/or environmental damage.

The subsurface flow control system 40 is shown by way of example in a vertical portion of the wellbore 16 below the surface 14, but may alternatively be installed anywhere within the wellbore 16 below the surface 14 and above a production zone 29. The subsurface flow control system 40 may include a primary SSV interconnected with the production tubing 26, as further detailed in subsequent figures. As built into the tubing string, the primary safety valve may be referred to as a tubing retrievable safety valve (TRSV).

A control line 34 may extend from the wellhead 32 along the annulus 17 between the wellbore 16 and the production tubing 26. The control 34 line may originate from a control manifold or pressure control system (not shown) located at, for example, a production platform, a subsea control station, or a pressure control system located at the surface 14 or downhole. The control line 34 may be a hydraulic conduit to supply pressurized control fluid to actuate the SSVs in the subsurface flow control system 40 to open and close flow from the wellbore 16. Control fluid pressure is applied via the control line 34 to open and maintain flappers of the SSV(s) open, thereby allowing production fluid 31 to flow uphole through the safety valve(s), through the production tubing 26, and to a surface location for production. To close the SSV(s), the hydraulic pressure in the control line 34 is reduced or eliminated. In the event the control line is severed or rendered inoperable, or if there is an emergency at a surface location, the default state for the safety valve(s) is to be closed to prevent production fluid 31 from advancing uphole past the subsurface flow control system 40.

Figure 2:
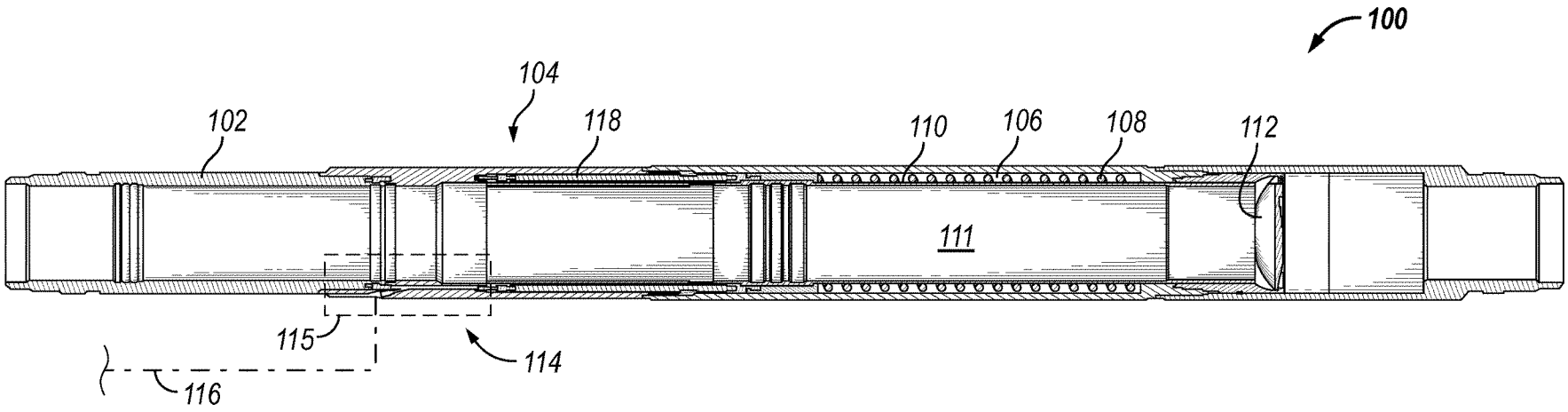
FIG. 2 is a sectional side-view of a primary subsurface safety valve for use with a subsurface flow control system for a well, such as the subsurface flow control system of FIG. 1.

FIG. 2 is a sectional side-view of a primary subsurface safety valve 100 for use with a subsurface flow control system for a well, such as the subsurface flow control system 40 of FIG. 1. The primary subsurface safety valve 100 is installed with a completions string in this embodiment. In a shut-in event, the primary subsurface safety valve 100 may be the first, or only, SSV available that the operator may use to try and shut-in flow. The primary safety valve 100 is, more particularly, a tubing-retrievable safety valve that may be integrated into production tubing of a completions string and may be alternately referred to as the TRSV 100 in this embodiment. Thus, the TRSV 100 may be deployed downhole and subsequently retrieved on tubing. The TRSV 100 includes a top sub 102 for coupling the TRSV 100 to a tubing string such as a production tubing string extending to surface. The TRSV 100 also includes a bottom sub 103 for coupling to a tubular component below the TRSV 100, such as additional production tubing of a completions system. A body of the valve 100 includes a valve housing 104 that may be formed of the top sub 102, bottom sub 103, and one or more tubular housing components between the top sub 102 and bottom sub 103. These housing components are connected to form a generally tubular structure that houses internal components and allow the flow of production fluid passing through the TRSV 100. For example, one tubular component of the valve housing 104 is a spring housing 106, which houses an actuator spring 108.

The TRSV 100 is hydraulically actuatable to open and close a flapper 112, which opens and closes flow of production fluid through the TRSV 100. One actuator component is a piston 118 that is hydraulically-actuated in response to control fluid pressure supplied to the piston via a control line. Another actuator component referred to herein as the flow tube 110 is disposed inside the valve housing 104 and passes through the spring housing 106 in this example. The flow tube 110 has an internal bore 111 to allow for flow of well fluids such as production fluids through the TRSV 100. The hydraulic-actuated piston 118 is used to move the flow tube 110 axially into and out of engagement with the flapper 112 to alternately open and close the flapper 112. The actuator spring 108 biases the piston 118 and flow tube 110 in an uphole direction (to the left in FIG. 2), as shown, so that the flapper 112 is defaulted to the closed position. However, a control line 116 may be connected to the TRSV 100 at a control line connection 114. Control fluid pressure may be supplied via the control line 116 to a control line port of the TRSV 100. Control fluid pressure above a certain threshold urges the flow tube 110 in a downhole direction, against the biasing action of the spring 108, to open the flapper 112. When control fluid pressure drops below that threshold, the flapper 112 closes. A portion 115 of the subsurface safety valve 100 is further detailed in FIG. 3.

Figure 3:
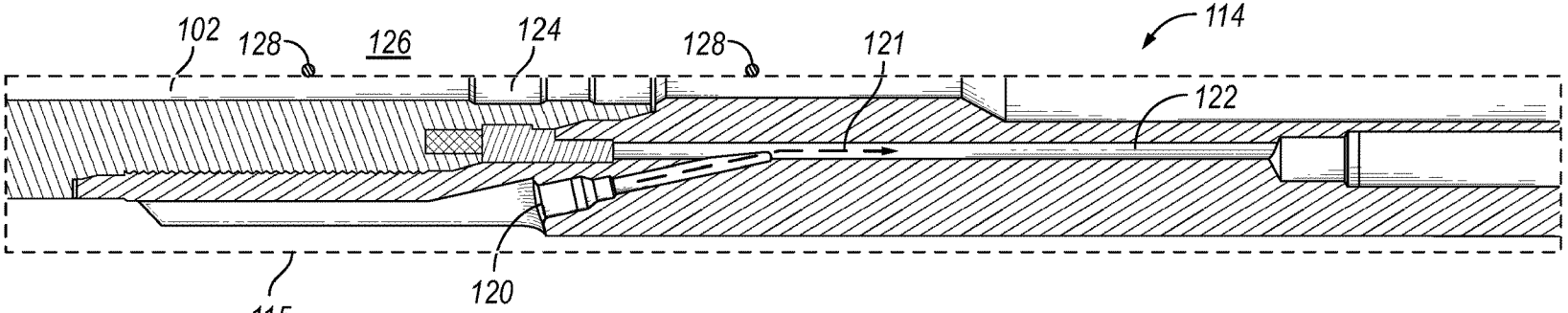
FIG. 3 is an enlarged view of the portion of the TRSV identified in FIG. 2 about the control line connection.

FIG. 3 is an enlarged view of the portion 115 of the TRSV 100 identified in FIG. 2, about the control line connection 114. A control line port 120 is provided for receiving control fluid pressure from a control line connected to the TRSV 100 at the control line connection 114. Control fluid pressure is then supplied via an internal flow path 122 to open the flapper of the TRSV according to the mechanism described above. Pressurized control fluid acts, and may flow (even if slightly), in the direction indicated at arrow 121 to open the TRSV. When control fluid pressure is removed or reduced below some threshold, the control fluid may flow in the opposite direction to allow the flow tube to move the other direction for the flapper to close.

The control fluid within the TRSV 100 is initially confined to move along the flow path 122. The body of the TRSV 100 includes a wall 124 separating the first control line port 120 from an interior 126 of the valve body of the TRSV 100. The wall 124 is on the top sub 102 in this example. A through-port may later be formed on this wall 124 to establish fluid communication from the control line port 120 to the interior 126 of the valve body. Pressurized control fluid may then be used to control a secondary, i.e., backup safety valve later disposed in the valve body of the TRSV 100. In one example, the wall 124 is puncturable to form the through-port on the wall 124 prior to disposing the backup safety valve within the primary safety valve. Typically, the through port will be formed on a separate trip prior to installing a backup safety valve. Seal locations 128 are indicated for sealing between the TRSV 100 and the backup safety valve in a way that confines control fluid pressure supplied to the TRSV's control line port 120 to flow to the backup safety valve, as will be further described below.

Figure 4:
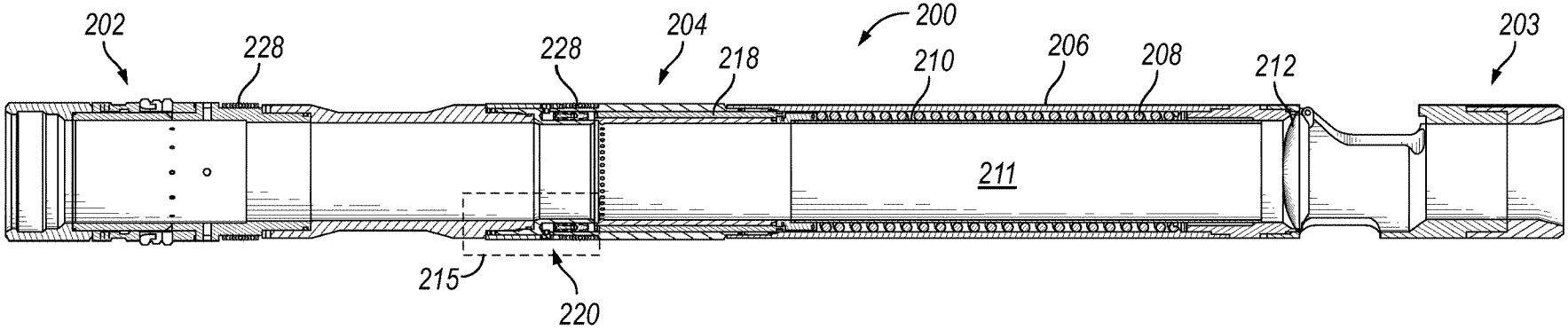
FIG. 4 is a sectional side-view of a backup safety valve for use with the subsurface flow control system.

FIG. 4 is a sectional side-view of a backup safety valve 200 for use with the subsurface flow control system. The backup safety valve 200 is deployable downhole and retrievable independently of the primary safety valve (e.g., independently of the TRSV 100 of FIG. 2). The backup safety valve 200 may be deployed and/or retrieved on a separate conveyance from the tubing that the TRSV is previously installed on. Generally, a backup safety valve may be configured for conveyance on a wireline (including variants thereof), coiled tubing, or even another tubing string that may be tripped downhole to install the backup safety valve in the body of the TRSV. In this example, the backup safety valve 200 is deployable on a wireline as the conveyance, and may be alternately referred to as the WLRSV 200. If the primary subsurface safety valve (FIG. 2) fails, such as failing to pass a regularly scheduled flapper leak test, the WLRSV 200 may be tripped downhole and installed in the body of the TRSV rather than replacing the TRSV. Subsequently, the TRSV and WLRSV may be open during production, and in a shut-in event, the TRSV and WLRSV may both be closed.

The WLRSV 200 includes a lock mandrel 202 for releasably locking the WLRSV 200 inside the TRSV. Below the lock mandrel 202 is a valve housing 204, which may include multiple tubular housing components connected to form a generally tubular structure that houses internal components of the WLRSV 200 and allow the flow of production fluid. For example, one tubular component of the valve housing 204 is a spring housing 206, which houses an actuator spring 208 of the WLRSV 200. Another tubular component of the valve housing 204 is generally referred to herein as a bottom sub 203, which is in direct or indirect fluid communication with production tubing below the WLRSV and TRSV. Seals 228 are provided at the locations 128 (FIG. 3) to seal between the outside of the WLRSV 200 and the inside of the TRSV upon full insertion of the WLRSV 200 into the TRSV to establish hydraulic communication with the control line connected to the TRSV.

The WLRSV 200 is hydraulically actuatable to open and close a flapper 212, which opens and closes flow of production fluid through the WLRSV 200. One actuator component is a piston 218 that is hydraulically-actuated in response to control fluid pressure supplied to the piston 218 via the same control line that is used to supply control fluid pressure to the TRSV of FIG. 2. Another actuator component referred to herein as the flow tube 210 is disposed inside the valve housing 204 and passes through the spring housing 206 in this example. The flow tube 210 has an internal bore 211 to allow for flow of well fluids such as production fluids through the WLRSV 200. The hydraulic-actuated piston 218 is used to move the flow tube 210 axially into and out of engagement with the flapper 212 to alternately open and close the flapper 212. The actuator spring 208 biases the piston 218 and flow tube 210 in an uphole direction (to the left in FIG. 4), as shown, so that the flapper 212 is defaulted to the closed position. However, control fluid pressure may be supplied from the same control line used to supply control fluid pressure to the TRSV (FIG. 2) and through the TRSV to a control line port 220 of the WLRSV 200 (i.e., the second control line port in this example), as further described below. Control fluid pressure above a certain threshold urges the flow tube 210 in a downhole direction, against the biasing action of the spring 208, to open the flapper 212. When control fluid pressure drops below that threshold, the flapper 212 closes. A portion 215 of the WLRSV 200 is further detailed in FIG. 5.

Figure 5:
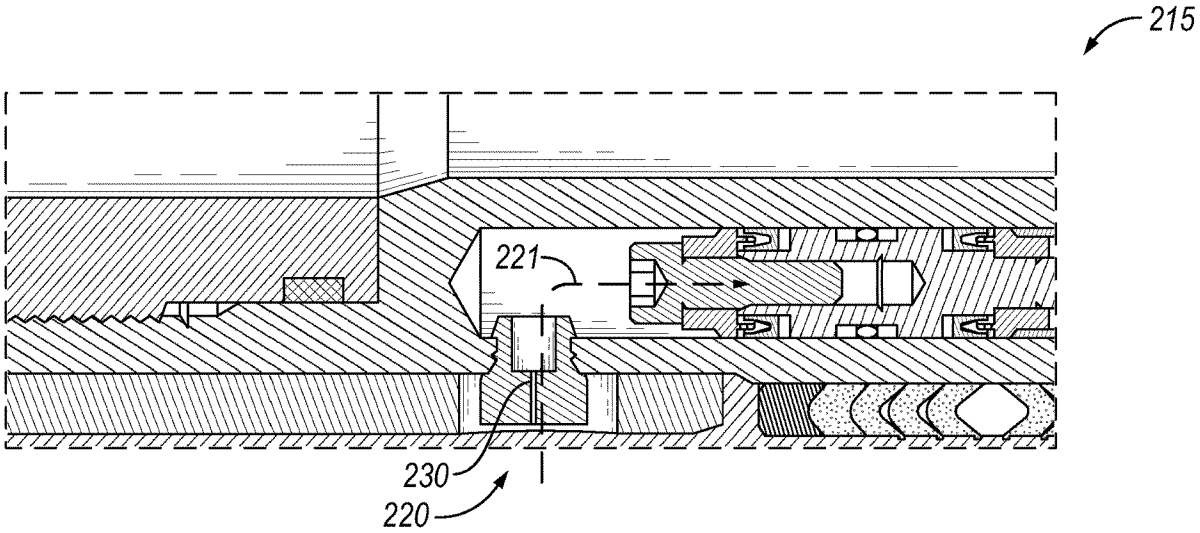
FIG. 5 is an enlarged view of the portion of the WLRSV identified in FIG. 4, about the control line port of the WLRSV.

FIG. 5 is an enlarged view of the portion 215 of the WLRSV 200 identified in FIG. 4, about the control line port 220 of the WLRSV 200. The control line port 220 is provided for receiving control fluid pressure from the control line connected to the TRSV (FIG. 2). Control fluid pressure is then passed through the TRSV to the WLRSV 200 to open the WLRSV according to the mechanism described above. Pressurized control fluid may act and may flow (even if slightly) in the direction indicated at arrow 221 to open the flapper of the WLRSV. When control fluid pressure is removed or reduced below some threshold, the control fluid may flow in the opposite direction to allow the flow tube to move the other direction for the flapper of the WLRSV to close. A choke 230 is provided in fluid communication with the second control line port 220. The choke 230 in this example is just inside the second control line port 220. The choke 230 restricts flow through the control line port 220 when the control fluid pressure drops, to delay a closing of the WLRSV flapper relative to a closing of the TRSV flapper in response to a decrease in the control fluid pressure. More particularly, the choke 230 may delay the closing of the WLRSV flapper by increasing the amount of time the control fluid pressure takes to drop below the threshold at which the WLRSV flapper is closed. Preferably, the delay is sufficient that the TRSV flapper is closed before the WLRSV flapper begins closing, so that the TRSV reduces flow as much as practicable before the WLRSV begin closing.

Figure 6:
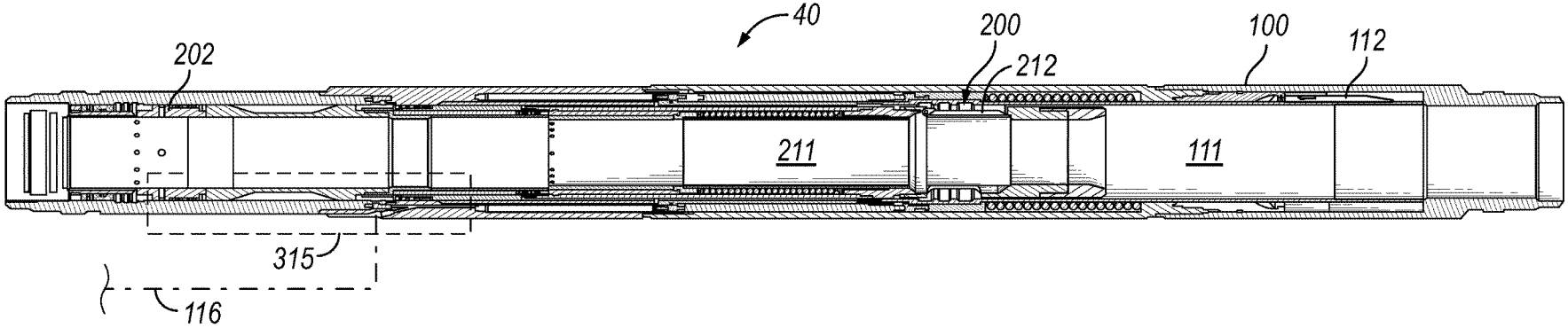
FIG. 6 now provides a sectional side-view of the subsurface flow control system with the WLRSV nested inside the TRSV and with both flappers open.

FIG. 6 now provides a sectional side-view of the subsurface flow control system 40 with the WLRSV 200 nested inside the TRSV 100 with both flappers 112, 212 open. The WLRSV 200 may have been lowered into the wellbore from surface on a wireline and locked in place inside the TRSV 100 via the lock mandrel 202. The WLRSV 200 may have been installed, for example, after identifying that the flapper 112 of the TRSV 100 leaked beyond some acceptable amount. For example, an industry standard API 14B allows a leak rate of up to 15 SCF/min of gas or 400 cc/min of liquid, so in just one non-limiting example the WLRSV 200 may be installed when a flapper is identified as exceeding that limit. Thus, the TRSV 100 may still close most of the flow of production fluid, but the WLRSV 200 is now in place to close off the remaining flow that may leak past the flapper 112 of the TRSV 100. The lock mandrel 202 may engage a feature within a bore of the TRSV 200 to axially secure the WLRSV 200 inside the TRSV 100. The internal bores 111, 211 of the respective flow tubes are in fluid communication. The WLRSV 200 is positioned inside the TRSV 100 and extends partially into the flow tube 110 of the TRSV 100 and terminates above the flapper 112 of the TRSV 100 so as not to interfere with movement of the TRSV's flapper 112. Control fluid pressure from the control line 116 is being used to hold both flappers 112, 212 open. With both flappers 112, 212 open, well fluids such as production fluid may flow through the subsurface flow control system 40. Production fluid flowing up through the subsurface flow control system 40 in this configuration would first enter the TRSV 100, flow up past the TRSV's flapper 112, enter the WLRSV 200 past the WLRSV's flapper 212, and uphole out of the subsurface flow control system 40. A portion 315 of the subsurface flow control system 40 is further detailed in FIG. 7.

Figure 7:
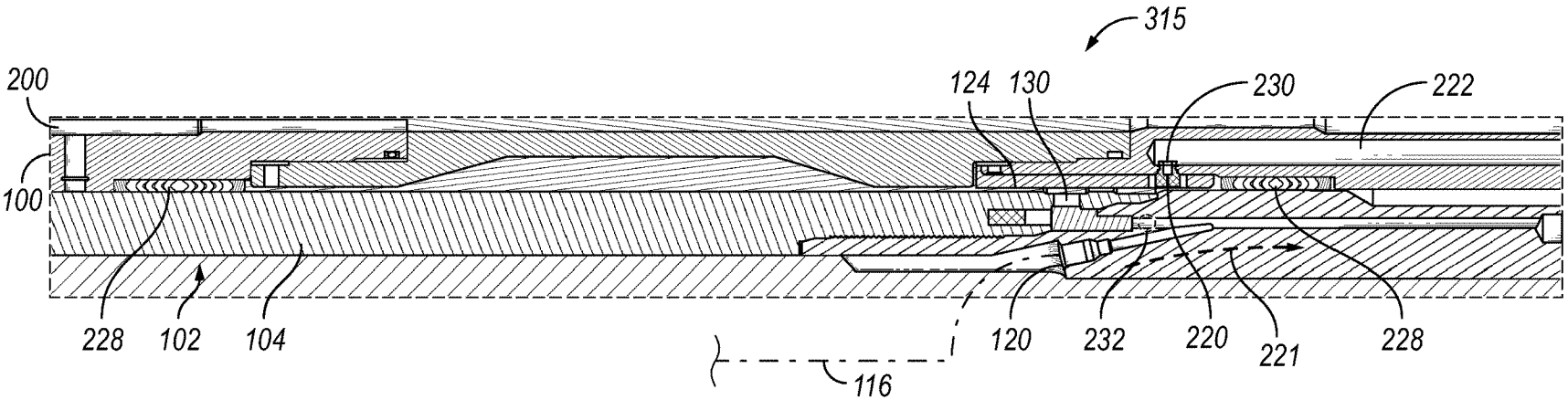
FIG. 7 is an enlarged view of the portion of the subsurface flow control system identified in FIG. 6, about the control line connection.

FIG. 7 is an enlarged view of the portion 315 of the subsurface flow control system 40 identified in FIG. 6, about the control line connection 114 (see, e.g., FIGS. 2 and 3). A through port 130 has now been formed on the wall 124 of the TRSV 100, and more particularly, on the top sub 102 of the valve housing 104. The seals 228 may automatically seal between the TRSV 100 and WLRSV 200 in response to insertion to the position where the WLRSV 200 locks into the TRSV 100. The seals 228 may isolate or constrain flow of control line fluid through the through port 120 and to the second control line port 220. Control fluid pressure supplied by the control line 116 to the TRSV's control fluid port 120 may now flow both along the direction 121 to open the TRSV and through the through port 130 and second control line port 220 to a hydraulic flow path 222 of the WLRSV 200 to open the WLRSV 200. Thus, control fluid from the same control line 116 may be used to open both the TRSV 100 and the WLRSV 200.

An example position of the choke 230 is also shown in FIG. 7, which is at least slightly inside the second control line port 220. An alternative choke location is indicated at 232, which is between the first control line port 120 and the second control line port 220. In either location, backflow of control line pressure from the WLRSV 200 to allow its flapper 212 to close is slowed through the choke 230 relative to backflow of control line pressure from the TRSV 100, so that the closing of the second flapper 212 is delayed with respect to closing of the first flapper 112.

Figure 8:
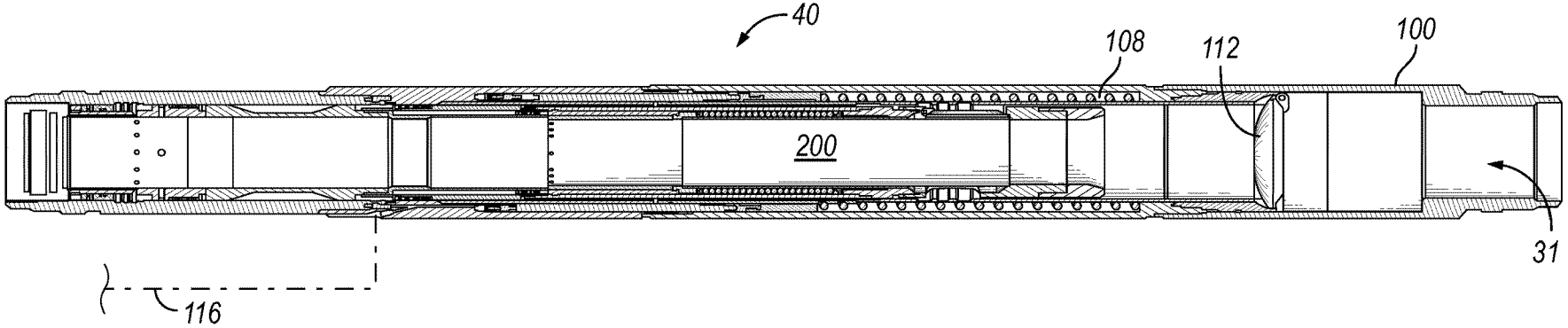
FIG. 8 is a sectional side view of the subsurface flow control system at some moment after control fluid pressure at the control line has been removed, shut off, or otherwise reduced below the threshold at which the flapper of the TRSV closes.

FIG. 8 is a sectional side view of the subsurface flow control system 40 at some moment after control fluid pressure at the control line 116 has been removed, shut off, or otherwise reduced below the threshold at which the flapper 112 of the TRSV 100 closes. The flapper 112 (referred to in this example as the first flapper) is now closed, such that a flow rate of production fluid 31 is significantly reduced by the TRSV, even though fluid may still leak past the closed flapper 112 of the TRSV 100 above some accepted leak rate. Meanwhile, even though control fluid pressure at the control line 116 has been reduced, the control fluid pressure seen by the hydraulic actuator of the WLRSV 200 is not yet below the threshold at which that flapper (referred to in this example as the second flapper) 212 is closed. This delay may be just long enough for the first flapper 112 to close, which typically is measured in seconds or even a fraction of a second. A technical advantage of delaying closure of the second flapper 112 is that the second flapper 212 will see a lower production fluid velocity when the second flapper 212 closes. Thus, the second flapper 212 may close more gently, i.e., with less force.

Delaying the closing of the second flapper 212 does not necessarily entail an attempt to hold the second flapper 212 partially open against the production fluid pressure below it. Once the control fluid pressure used to hold the flapper 212 open drops below the threshold, the flow tube 210 of the WLRSV 200 shifts axially out of the way of the second flapper 212 so the second flapper 212 may close promptly, so as not to try and resist production fluid pressure acting below the second flapper 212. The second flapper 212 may close more gently when the first flapper 112 is already closed because the production fluid pressure on the second flapper 212 is less than what it would be if the first flapper 112 were still fully open. However, the reduction in closing force of the second flapper 212 is primarily due to that reduction of production fluid pressure and/or fluid flow rate of production fluid 31.

Figure 9:
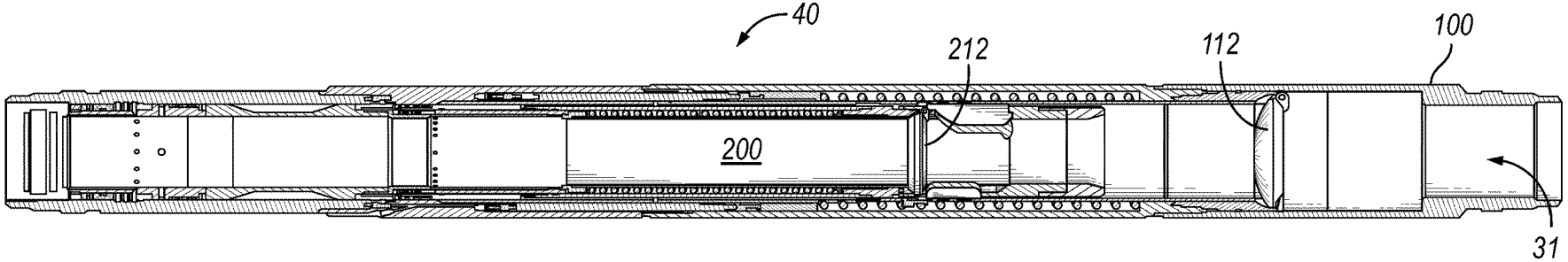
FIG. 9 is a sectional side view of the subsurface flow control system after the second flapper has closed, at some moment after the first flapper closed as in FIG. 8.

FIG. 9 is a sectional side view of the subsurface flow control system 40 after the second flapper 212 has now closed, which is some moment after the first flapper 112 closed as in FIG. 8. Flow of any production fluid 31 leaking past the first flapper 112 of the TRSV 100 may be substantially closed now by the closed second flapper 212. Thus, the production from the well may be maintained and shut off periodically as needed, either for maintenance or other shut-in events, by closing the flapper 112 of the TRSV 100 followed by closing the flapper 212 of the WLRSV 200.

Accordingly, the present disclosure provides a. The disclosed tool, actuator, and method may include any of the various features disclosed herein, including one or more of the following statements.

Statement 1. A flow control system for a well, comprising: a primary safety valve for controlling flow from production tubing in the well, the primary safety valve including a first valve body, a first flapper, a first control line port for receiving control fluid pressure from a control line, and a first actuator operable to open the first flapper in response to the control fluid pressure; a secondary safety valve disposable within the valve body of the primary safety valve, the secondary safety valve including a second valve body, a second flapper, a second control line port for receiving control fluid pressure from the same control line as the primary safety valve when the secondary safety valve is disposed in the first valve body of the primary safety valve, and an actuator operable to open the second flapper in response to the control fluid pressure; and a choke in fluid communication with the second control line port to delay a closing of the second flapper relative to a closing of the first flapper in response to a decrease in the control fluid pressure.

Statement 2. The flow control system of Statement 1, wherein the secondary safety valve is independently disposable within and retrievable from the first valve body after the primary safety valve is installed with the production tubing downhole.

Statement 3. The flow control system of Statement 1 or 2, further comprising: a wall separating the first control line port from an interior of the first valve body; a through-port from the first control line port to the interior of the first valve body; and wherein the second control line port is automatically positioned in fluid communication with the first control line port via the through port when the secondary safety valve is disposed in the first valve body.

Statement 4. The flow control system of Statement 3, wherein the wall is puncturable to form the through-port with the primary safety valve installed in the well prior to disposing the secondary safety valve within the primary safety valve.

Statement 5. The flow control system of Statement 3 or 4, further comprising: one or more sealing members for sealing between the second valve body and the first valve body in response to disposing the secondary safety valve within the primary safety valve, the one or more sealing members straddling the through port.

Statement 6. The flow control system of any of Statements 1 to 5, wherein the choke is disposed on the second valve body inside the second control line port to establish the fluid communication of the choke with the second control line port.

Statement 7. The flow control system of any of Statements 1 to 6, wherein the choke is disposed on the first valve body between the first control line port and the second control line port.

Statement 8. The flow control system of any of Statements 1 to 7, wherein the primary safety valve is a tubing retrievable safety valve ("TRSV") and the secondary safety valve is a wireline retrievable safety valve ("WLRSV").

Statement 9. The flow control system of any of Statements 1 to 8, further comprising: a lock mandrel configured for coupling to the WLRSV for securing the WLRSV inside the TRSV when deployed into the first valve body of the WLRSV.

Statement 10. The flow control system of any of Statements 1 to 9, wherein the secondary safety valve has a lower slam closure rating than the primary safety valve.

Statement 11. A flow control system for a well, comprising: a tubing retrievable safety valve (TRSV) installed with a well completion to control flow from a production tubing, the tubing retrievable safety valve including a first valve body, a first flapper, a first control line port for receiving control fluid pressure from a control line, and a first actuator operable to open the first flapper in response to the control fluid pressure; a wireline retrievable safety valve (WLRSV) retrievably deployable downhole into the valve body of the tubing retrievable safety valve, the wireline retrievable safety valve including a second valve body, a second flapper, a second control line port in fluid communication with the first control line port via a through port for receiving control fluid pressure from the same control line as the tubing retrievable safety valve, and an actuator operable to open the second flapper in response to the control fluid pressure; a lock mandrel coupled to the WLRSV for securing the WLRSV inside the TRSV when deployed into the valve body of the WLRSV; and a choke in fluid communication with the second control line port to delay a closing of the second flapper relative to a closing of the first flapper in response to a decrease in the control fluid pressure.

Statement 12. The flow control system of Statement 11, wherein the choke is disposed on the second valve body within the second control line port to establish the fluid communication of the choke with the second control line port.

Statement 13. The flow control system of Statement 11 or 12, wherein the choke is disposed on the first valve body within the first control line port to establish the fluid communication of the choke with the second control line port.

Statement 14. The flow control system of any of Statements 11 to 13, wherein the WLRSV has a lower slam closure rating than the TRSV.

Statement 15. A method of controlling flow from a well, comprising: flowing a well fluid through a primary safety valve and a secondary safety valve disposed within a valve body of the primary safety valve; holding the primary safety valve open by supplying a control fluid from a control line through a first control line port; holding the secondary safety valve open by supplying the control fluid from the same control line through a second control line port; in response to detecting a shut-in event, closing the primary valve and the secondary valve by reducing a control line pressure to generate a backflow of the control fluid through the first and second control line ports to close the primary valve and the secondary valve; and choking the backflow through the second control line port to delay the closing of the secondary safety valve relative to a closing of the primary safety valve.

Statement 16. The method of any of Statement 15, further comprising: initially flowing the well fluid through just the primary safety valve without the secondary safety valve disposed within the valve body of the primary safety valve; and in response to detecting a leakage through the primary safety valve, subsequently installing the secondary safety valve within the valve body of the primary safety valve.

Statement 17. The method of Statement 16, wherein detecting a leakage comprises detecting a leak rate exceeding 15 SCF/min of gas or 400 cc/min.

Statement 18. The method of Statement 16 or 17, further comprising: forming a through-port from the first control line port to an interior of the valve body of the primary safety valve; and positioning the second control line port in fluid communication with the first control line port via the through-port when installing the secondary safety valve in the valve body of the primary safety valve.

Statement 19. The method of Statement 18, wherein forming the through-port comprises puncturing a wall separating the first control line port from an interior of the valve body of the primary safety valve.

Statement 20. The method of any of Statements 15 to 19, wherein flowing a well fluid through the primary safety valve and the secondary safety valve comprising producing oil or gas from a hydrocarbon-bearing formation.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A flow control system for a well, comprising:

a primary safety valve for controlling flow from production tubing in the well, the primary safety valve including a first valve body, a first flapper, a first control line port for receiving control fluid pressure from a control line, and a first actuator operable to open the first flapper in response to the control fluid pressure;

a secondary safety valve independently disposable within and retrievable from the first valve body after the primary safety valve is installed with the production tubing downhole, the secondary safety valve including a second valve body, a second flapper, a second control line port for receiving control fluid pressure from the same control line as the primary safety valve when the secondary safety valve is disposed in the first valve body of the primary safety valve, and an actuator operable to open the second flapper in response to the control fluid pressure; and a choke in fluid communication with the second control line port to delay a closing of the second flapper relative to a closing of the first flapper in response to a decrease in the control fluid pressure.

2. The flow control system of claim 1, further comprising:

a wall separating the first control line port from an interior of the first valve body;

a through-port from the first control line port to the interior of the first valve body; and wherein the second control line port is automatically positioned in fluid communication with the first control line port via the through port when the secondary safety valve is disposed in the first valve body.

3. The flow control system of claim 2, wherein the wall is puncturable to form the through-port with the primary safety valve installed in the well prior to disposing the secondary safety valve within the primary safety valve.

4. The flow control system of claim 2, further comprising:

one or more sealing members for sealing between the second valve body and the first valve body in response to disposing the secondary safety valve within the primary safety valve, the one or more sealing members straddling the through port.

5. The flow control system of claim 1, wherein the choke is disposed on the second valve body inside the second control line port to establish the fluid communication of the choke with the second control line port.

6. The flow control system of claim 1, wherein the choke is disposed on the first valve body between the first control line port and the second control line port.

7. The flow control system of claim 1, wherein the primary safety valve is a tubing retrievable safety valve ("TRSV") and the secondary safety valve is a wireline retrievable safety valve ("WLRSV").

8. The flow control system of claim 1, further comprising:

a lock mandrel configured for coupling to the WLRSV for securing the WLRSV inside the TRSV when deployed into the first valve body of the WLRSV.

9. The flow control system of claim 1, wherein the secondary safety valve has a lower slam closure rating than the primary safety valve.

10. A flow control system for a well, comprising:

a tubing retrievable safety valve (TRSV) installed with a well completion to control flow from a production tubing, the tubing retrievable safety valve including a first valve body, a first flapper, a first control line port for receiving control fluid pressure from a control line, and a first actuator operable to open the first flapper in response to the control fluid pressure;

a wireline retrievable safety valve (WLRSV) retrievably deployable downhole into the valve body of the tubing retrievable safety valve, the wireline retrievable safety valve including a second valve body, a second flapper, a second control line port in fluid communication with the first control line port via a through port for receiving control fluid pressure from the same control line as the tubing retrievable safety valve, and an actuator operable to open the second flapper in response to the control fluid pressure;

a lock mandrel coupled to the WLRSV for securing the WLRSV inside the TRSV when deployed into the valve body of the WLRSV; and a choke in fluid communication with the second control line port to delay a closing of the second flapper relative to a closing of the first flapper in response to a decrease in the control fluid pressure.

11. The flow control system of claim 10, wherein the choke is disposed on the second valve body within the second control line port to establish the fluid communication of the choke with the second control line port.

12. The flow control system of claim 10, wherein the choke is disposed on the first valve body within the first control line port to establish the fluid communication of the choke with the second control line port.

13. The flow control system of claim 10, wherein the WLRSV has a lower slam closure rating than the TRSV.

14. A method of controlling flow from a well, comprising:

flowing a well fluid through a primary safety valve and a secondary safety valve disposed within a valve body of the primary safety valve;

holding the primary safety valve open by supplying a control fluid from a control line through a first control line port;

holding the secondary safety valve open by supplying the control fluid from the same control line through a second control line port;

in response to detecting a shut-in event, closing the primary valve and the secondary valve by reducing a control line pressure to generate a backflow of the control fluid through the first and second control line ports to close the primary valve and the secondary valve; and choking the backflow through the second control line port to delay the closing of the secondary safety valve relative to a closing of the primary safety valve.

15. The method of claim 14, further comprising:

initially flowing the well fluid through just the primary safety valve without the secondary safety valve disposed within the valve body of the primary safety valve; and in response to detecting a leakage through the primary safety valve, subsequently installing the secondary safety valve within the valve body of the primary safety valve.

16. The method of claim 15, wherein detecting a leakage comprises detecting a leak rate exceeding 15 SCF/min of gas or 400 cc/min of liquid.

17. The method of claim 15, further comprising:

forming a through-port from the first control line port to an interior of the valve body of the primary safety valve; and positioning the second control line port in fluid communication with the first control line port via the through-port when installing the secondary safety valve in the valve body of the primary safety valve.

18. The method of claim 17, wherein forming the through-port comprises puncturing a wall separating the first control line port from an interior of the valve body of the primary safety valve.

19. The method of claim 14, wherein flowing the well fluid through the primary safety valve and the secondary safety valve comprises producing oil or gas from a hydrocarbon-bearing formation.

* * * * *